US009980574B2

(12) United States Patent
Abraham et al.

(10) Patent No.: US 9,980,574 B2
(45) Date of Patent: May 29, 2018

(54) BED AND BED INSERT WITH POSTURAL SUPPORT

(71) Applicants: Oswald Abraham, Cranbourne East, Victoria (AU); Cynthia Abraham, Cranbourne East, Victoria (AU)

(72) Inventors: Oswald Abraham, Cranbourne East (AU); Ambarish Kulkarni, Clarinda (AU)

(73) Assignees: Oswald Abraham, Cranbourne East, Victoria (AU); Cynthia Abraham, Cranbourne East, Victoria (AU)

( * ) Notice: Subject to any disclaimer, the term of this patent is extended or adjusted under 35 U.S.C. 154(b) by 0 days. days.

(21) Appl. No.: 15/514,543

(22) PCT Filed: Sep. 29, 2015

(86) PCT No.: PCT/AU2015/050585
§ 371 (c)(1),
(2) Date: Mar. 27, 2017

(87) PCT Pub. No.: WO2016/049696
PCT Pub. Date: Apr. 7, 2016

(65) Prior Publication Data

US 2017/0224121 A1 Aug. 10, 2017

(30) Foreign Application Priority Data

Sep. 30, 2014 (AU) ..... 2014903889

(51) Int. Cl.
*A47C 20/04* (2006.01)
*A61G 7/015* (2006.01)
(Continued)

(52) U.S. Cl.
CPC ..... *A47C 20/041* (2013.01); *A61G 7/015* (2013.01); *A61G 7/018* (2013.01); *A61G 7/07* (2013.01)

(58) Field of Classification Search
CPC ..... A61G 7/002; A61G 7/005; A61G 7/012; A61G 7/015; A61G 7/018; A61G 7/065;
(Continued)

(56) References Cited

U.S. PATENT DOCUMENTS 933,323 A * 9/1909 Mitchell ..... A61G 7/012 5/611
974,287 A * 11/1910 May ..... A61G 7/015 5/132

(Continued)

OTHER PUBLICATIONS

Australian Patent Office, International Search Report and Written Opinion on PCT/AU2015/050585, Nov. 17, 2015, Woden Act 2606, Australia.

*Primary Examiner* — Robert G Santos
(74) *Attorney, Agent, or Firm* — Louis Ventre, Jr.

(57) ABSTRACT

The invention provides a bed capable of providing postural support to a user, the bed comprising: a headrest (10) having an adjustable height; a backrest (12) having an adjustable angle (α) of inclination to incline the user's back; and a shoulder and arm rest (11) positioned between the headrest and the backrest; wherein the headrest (10), backrest (12) and the shoulder and arm rest (11) are configurable to form a channel (14) extending between and separating the headrest (10 and the backrest (12) when the headrest (10) and backrest (12) are adjusted in elevated positions, and configurable to form a substantially even sleeping surface of the backrest (12) and shoulder and arm rest (11) without forming the channel (14) when the backrest (12) is adjusted to a flat angle of inclination. The invention also provides an insert capable of being inserted into an outer bed frame in the construction of the bed, and a kit for construction of the bed.

19 Claims, 4 Drawing Sheets

(51) Int. Cl.
*A61G 7/07* (2006.01)
*A61G 7/018* (2006.01)

(58) Field of Classification Search
CPC ..... A61G 7/07; A61G 7/072; A61G 13/02; A61G 13/04; A61G 13/06; A61G 13/08; A47C 20/04; A47C 20/041; A47C 20/08
USPC ... 5/616–618, 613, 612, 722, 731, 733, 735, 5/937
See application file for complete search history.

(56) References Cited

U.S. PATENT DOCUMENTS

| | | | | | |
|---|---|---|---|---|---|
| 2,182,861 | A * | 12/1939 | Albert | A61G 7/065 | 5/722 |
| 2,550,293 | A * | 4/1951 | Platis | A47C 27/001 | 5/722 |
| 3,795,018 | A * | 3/1974 | Broaded | A47C 20/00 | 5/613 |
| 5,208,928 | A | 5/1993 | Kuck et al. | | |
| 5,392,479 | A * | 2/1995 | Liao | A61G 7/001 | 5/607 |
| 8,661,591 | B1 * | 3/2014 | Sonderland | A61G 7/065 | 5/722 |
| 2007/0289064 | A1 | 12/2007 | Martin et al. | | |
| 2017/0224121 | A1 * | 8/2017 | Abraham | A47C 20/041 | |

* cited by examiner

Fig 1
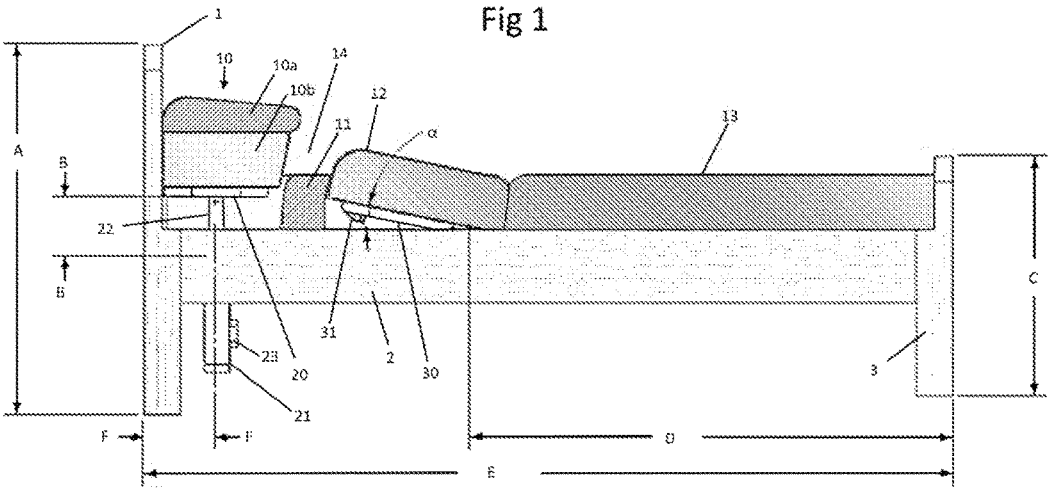
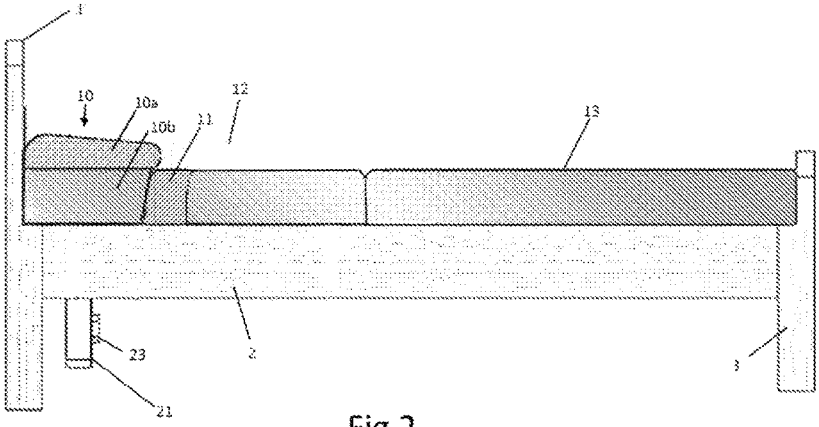
Fig 2

BED AND BED INSERT WITH POSTURAL SUPPORT

FIELD

The present invention relates to beds which are capable of providing postural support to a user, in particular to an improved bed in which the user's upper body may be inclined. The invention may be useful in the prevention or amelioration of sleep apnoea, gastro-oesophageal reflux disease or any relevant medical or postural need for improved comfort, health or sleep quality of the user or their sleeping partner.

BACKGROUND

Oswald Abraham, in international patent publication WO2009/103109 (also granted as Australian patent 2009217220), disclosed an improved postural support pillow with a headrest and a backrest adapted to support the head and back (or rib cage) of a user, with a channel separating the head and back rests for accommodating the user's arm at least in part. The pillow has proved successful for many users for a number of conditions, including sleep apnoea, pain caused by irritation of the oesophagus by refluxing stomach acids in gastro-oesophageal reflux disease, and many other posturally sensitive conditions. The disclosures of WO2009/103109 are incorporated herein by reference.

Pillows are only adjustable for a user's changing preferences or needs, by adjusting the level of inflation in the case of an air filled pillow or by cumbersome removable inserts, and can be inconvenient to position and store. There is therefore a need to provide an improved apparatus which is easily adjustable and solves the convenience and storage problem.

The current invention stems from the realisation that the simple geometrical structure of the Abraham pillow allows a convenient implementation in the form of adjustable bed, providing an elegant solution to the above-mentioned shortcomings.

SUMMARY OF THE INVENTION

In accordance with a first broad aspect of the invention there is provided a bed capable of providing postural support to a user, the bed comprising:

- a headrest having an adjustable height;
- a backrest having an adjustable angle of inclination to incline the user's back; and
- a shoulder and arm rest positioned between the headrest and the backrest;
- wherein the headrest, backrest and the shoulder and arm rest are configurable to form a channel extending between and separating the headrest and the backrest when the headrest and backrest are adjusted in elevated positions, and configurable to form a substantially even sleeping surface of the backrest and shoulder and arm rest without forming the channel when the backrest is adjusted to a flat angle orientation.

In one embodiment, the backrest inclines from a middle region of the bed and in a lower region of the bed is disposed a lower body rest.

In one embodiment the shoulder and arm rest does not have an adjustable height.

In one embodiment, the headrest comprises a headrest cushion supported by a headrest base, the headrest base being connected to a headrest actuator to provide the adjustable height. The headrest actuator may comprise a headrest electric motor and a headrest actuator shaft connected to the headrest base from below.

In one embodiment, the backrest comprises a backrest cushion supported by a backrest base, the backrest base being connected to a backrest actuator to provide the adjustable inclination. The backrest actuator may comprise a backrest electric motor and backrest actuator shaft connected to the backrest base from below.

In one embodiment, is adjustable to an elevation of at least 30 mm, preferably 60 mm and more preferably 90 mm from a lowermost position of the headrest, and the backrest is adjustable to an angle of inclination of at least 5°, preferably 10° and more preferably 15° from horizontal. The headrest and the backrest may be adjustable continuously between the lower most and uppermost positions. Alternatively, the headrest and the backrest may be adjustable to a number of positions.

In one embodiment, the headrest and the backrest are independently adjustable.

In accordance with a 2nd broad aspect of the invention, there is provided an insert capable of being inserted into an outer bed frame in the construction of the bed of the first broad aspect of the invention, the insert comprising:

- an insert frame;
- a headrest base adapted to support a headrest cushion and connected through a headrest actuator to the insert frame to provide the adjustable height of the headrest;
- a shoulder and arm rest base adapted to support a shoulder and arm rest cushion; and
- a backrest base adapted to support a backrest cushion and connected through a backrest actuator to the insert frame to provide the adjustable inclination.

In one embodiment, the insert frame is constructed in two parts, an upper body part receiving the headrest base and backrest base, and a lower body part adapted to support a lower body cushion. The 2 parts may be detachable.

In one embodiment, the headrest actuator is attached to the insert frame at a frame extension disposed beneath the headrest base.

In one embodiment, the backrest actuator is attached to the insert frame at an extension arm extending beneath a pivot axis of the backrest base.

In accordance with a 3rd broad aspect of the invention, there is also provided a kit comprising the insert of the 2nd broad aspect of the invention, the headrest cushion, the shoulder and arm rest cushion and the backrest cushion.

The kit may also comprise the lower body cushion.

BRIEF DESCRIPTION OF DRAWINGS

FIG. 1 is a side view of a bed constructed in accordance with an embodiment of the invention, in an elevated position;

FIG. 2 is a side view of the bed of FIG. 1 in a lowered position;

DETAILED DESCRIPTION OF EMBODIMENTS

Figure 3:
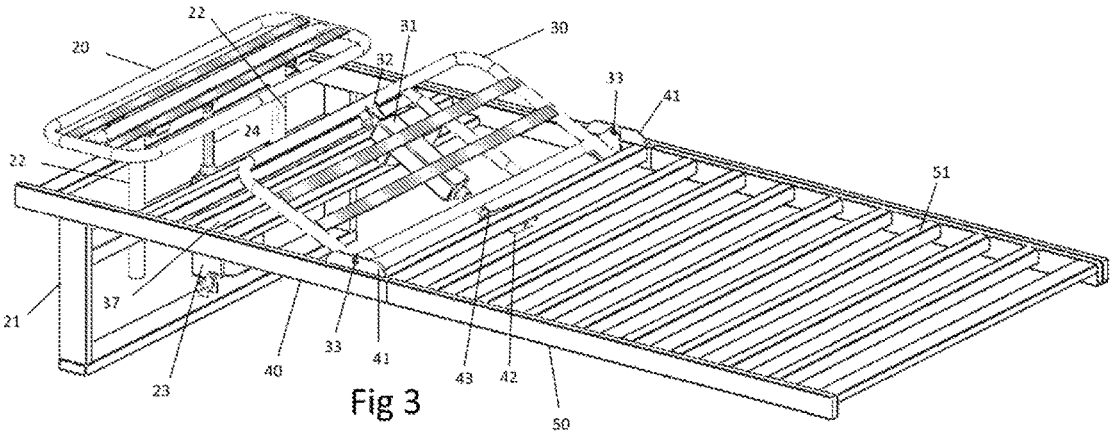
FIG. 3 is a perspective view of an insert disposed inside the bed of FIG. 1.

An embodiment of the current invention will now be described.

Referring first to FIG. 1, a side view is provided of a bed in accordance with an embodiment of the invention, adjusted into an elevated position. The bed comprises an outer bed frame constructed of wood and comprising bed head 1, bed side panels 2 and bed foot 3, and is integral with headrest, shoulder and arm rest, and backrest.

The bed sleeping surface is divided into separate cushions, typically constructed from or polyurethane foam of suitable density or latex foam material, including a headrest cushion 10 with an upper part 10*a* disposed above a lower part 10*b*, a shoulder and arm rest cushion 11, a backrest cushion 12 pivoting from a middle region of the bed and a lower body cushion 13. Upper part 10*a* of headrest cushion 10 has a thickness ranging from about 35 mm at the front 60 mm at the back thereof and extends slightly over channel 14 for sleeping comfort as described in the Abraham pillow prior art. As is described in WO2009/103109, the cushions may be composed of foam having different densities in different regions, to provide the most comfortable and ergonomically advantageous posture of the user to align the head, neck and spine.

Headrest cushion 10 is supported by headrest base 20 which has an adjustable height stabilised in linear motion by headrest guide rails 22. Headrest base 20 is attached to an actuator powered by an electric actuator motor 23. The actuator is installed on a frame extension 21 of an insert frame (not visible). Backrest cushion 12 is supported by backrest base 30 which is adjustable through a backrest actuator, of which the gearbox 31 is visible, to provide different angles of inclination $\alpha$. Typical dimensions of the bed and its components are labelled in the diagram. Height A of bed head 1 is about 1000 mm. The distance B between the sleeping headrest position shown the diagram and the lowermost position of the headrest base 20 is ideally about 150 mm. use for maximum elevations of the headrest range from 30 mm, which may be suitable for small children. The angle of inclination $\alpha$ between the typical sleeping position shown the diagram and the horizontal is ideally about 18.5°. Useful angles of maximum inclination range from 5° which may be suitable for small children. The distance F between the headrest guide rails 22 and the back of the bed head 1 is about 200 mm. The overall length of the bed E is about 2200 mm and the distance D from a pivoting axis of the backrest base 30 and the front of the bed end 3 is about 1300 mm. The height of the bed end C is about 650 mm. All these dimensions are exemplary only and can be varied depending on body size and need.

When adjusted into an elevated position, a channel 14 extends laterally between the headrest 10 and the backrest 12, a base of the channel 14 being formed by shoulder and arm rest 11 which extends between and separates headrest 10 and backrest 12. This essentially enables provision of the sleeping position provided by the above-mentioned Abraham pillow of the prior art.

Referring now to FIG. 2, the bed of FIG. 1 is shown with the headrest 10 and backrest 12 adjusted into the lowermost position, in line with shoulder and arm rest 11 and lower body cushion 13, producing a mostly regular flat sleeping arrangement, being a substantially even sleeping surface of the backrest 12 and shoulder and arm rest 11 without forming a channel.

Referring now to FIG. 3, an insert of the 2nd aspect of the invention is shown separated from its installation into the bed of FIG. 1. The insert is primarily constructed from wood and tubular steel where necessary, designed using finite element analysis to arrive at a strong, sufficiently lightweight and economical design. The particular compositions of this embodiment and proportions shown in the diagram have been optimised by utilisation of virtual reality techniques, but less technically advanced methods such as rule of thumb and trial and error are of course able to be used as are known in the art to arrive at workable designs.

The insert comprises an insert frame in 2 parts, an upper body part 40 receiving the headrest base 20 and backrest base 30 and having wooden or stiff elastic slats such as 37 therebetween to provide a base for the shoulder and arm rest 11, and also having a lower body part 50 with wooden or stiff elastic slats such as 51 supporting the stationary lower body cushion 13. The insert essentially replaces the usual supporting base of wooden slats in a wooden frame bed and is installed over the interior shelves provided alongside panels 2. Normally, upper body part 40 and lower body part 50 of the insert frame are attached together with metal locking plates (not shown). The provision of 2 parts enables manufacture of varying length insert frames to suit different lengths of beds.

Headrest base 20 is connected to the insert frame at frame extension 21 which is bolted using a metal bracket or otherwise rigidly attached to upper body part 40. Frame extension 21 houses actuator with actuator gearbox 23 and actuator shaft 24 with guide rails 22 assisting in stabilising the linear movement. Backrest base 30 is attached to a metal receiving part 41 in upper body part 40 at a pivot attachment point 33. A backrest actuator (of which gearbox 31 is visible) is pivotally attached to backrest base 30 at an attachment part 32 at one end, and is attached through an actuator shaft to the upper body part 40 of the insert frame at the attachment point 43 on the end of an extension arm 42, the extension arm 42 providing the requisite geometry to allow pivoting of the backrest base 30 from a lower most inclination in the flat position to an uppermost inclination of ideally at least about 18.5°.

Figure 4:
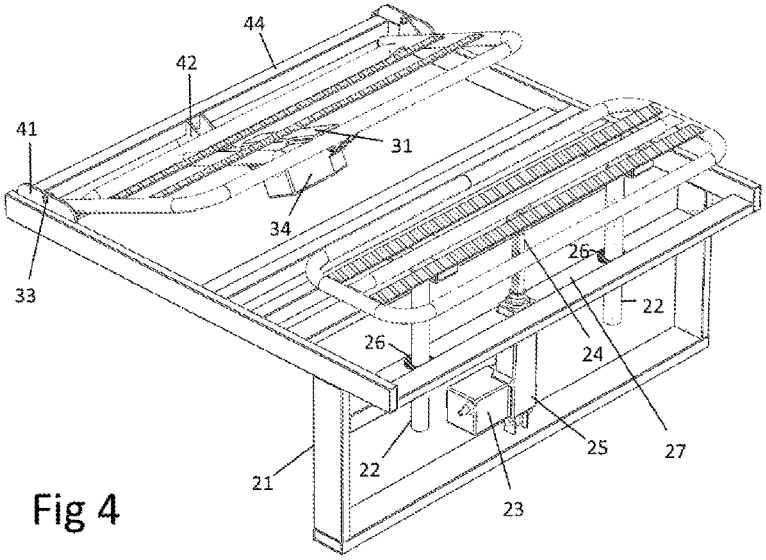
FIG. 4 is a perspective view of an upper body frame part of the insert of FIG. 3.

Referring now to FIG. 4, further details are visible. In relation to backrest base 30 and its operation, steel extension arm 42 is shown attached to steel cross beam 44 of upper body part 40, and actuator motor 34 drives the actuator shaft through gearbox 31. In relation to headrest base 20 and its operation, wooden frame extension 21 is attached to actuator gearbox 25 and actuator motor 23 is visible. Wooden cross beam 27 of frame extension 21 houses an upper end of actuator gearbox 25 through which emerges actuator shaft 24. Cross beam 27 also houses nylon lined steel bushes 26 through which guide rails 22 slide.

Figure 5A:
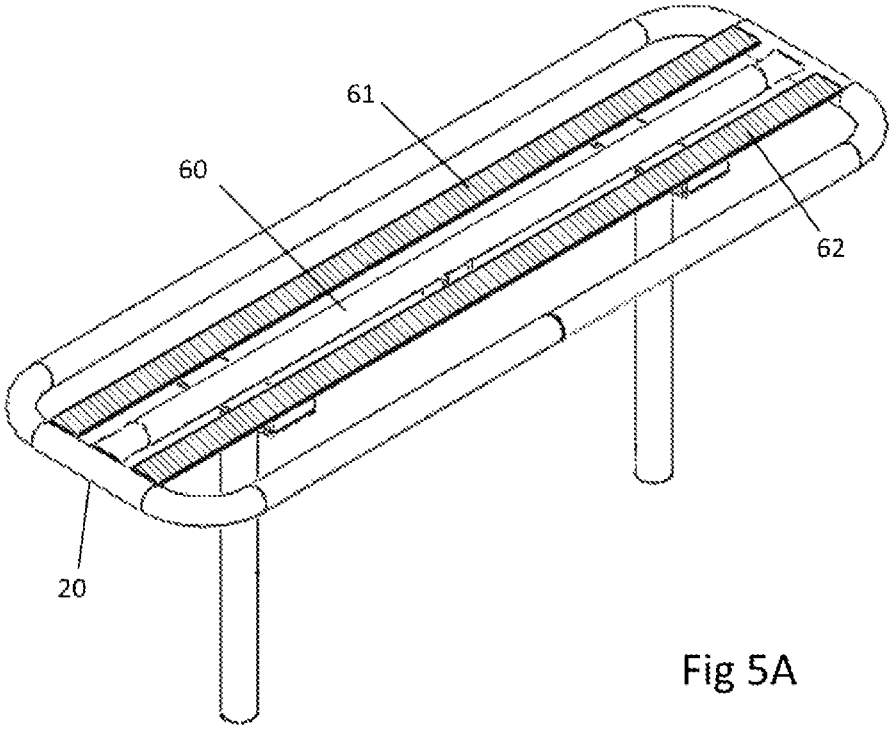
FIG. 5A is a perspective view of the headrest base of the bed of FIG. 1.

Referring now to FIG. 5A, further details of headrest base 20 are shown. The base 20 is bordered by tubular steel of circular cross-section, and a central tubular steel strut 60 of circular cross-section strengthens the centre. Flat wooden or stiff elastic slats 61 serve to close the base sufficiently to support for the headrest cushion 10.

Figure 5B:
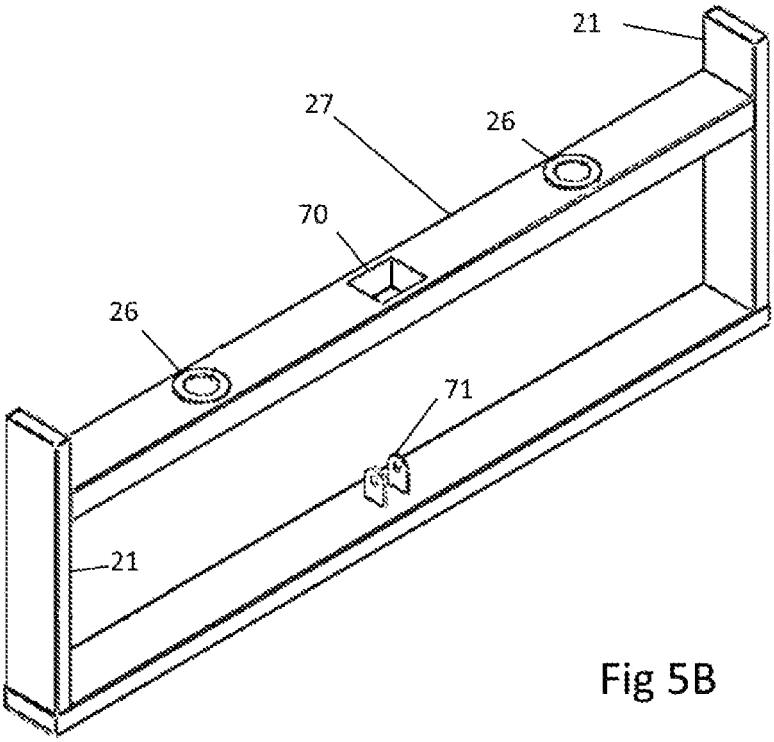
FIG. 5B is a perspective view of a frame extension part of the bed of FIG. 1 adapted to receive the headrest base and headrest actuator.

Referring now to FIG. 5B, frame extension 21 is shown in isolation, including metal attachment point 71 for attachment of actuator gearbox 25 and square aperture 70 in wooden cross beam 27 which houses the upper end of actuator gearbox 25.

Figure 6:
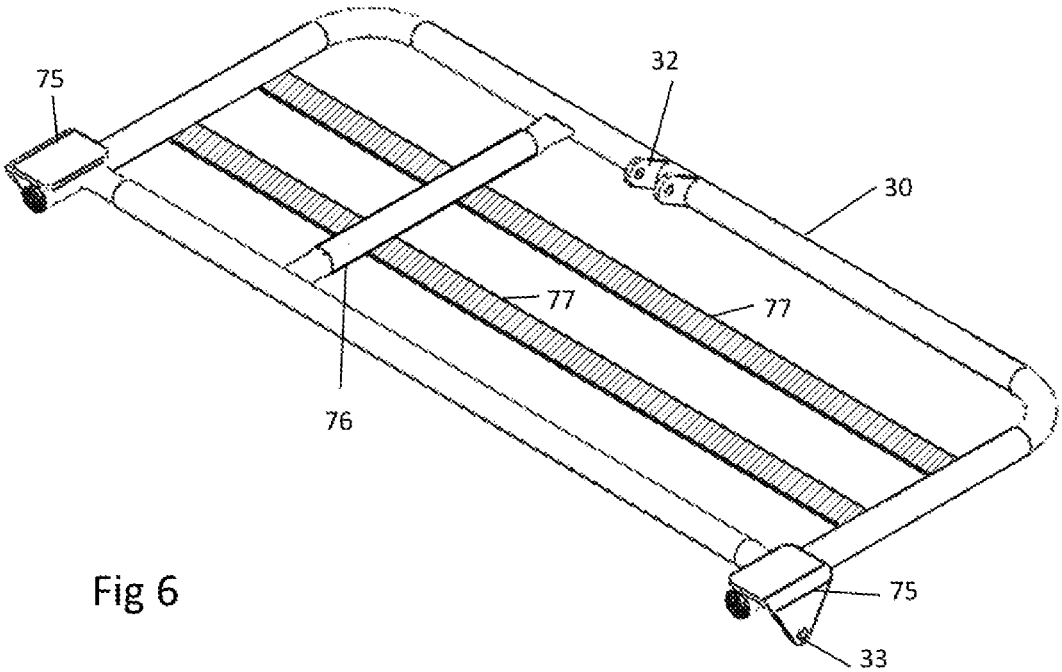
FIG. 6 is a perspective view of the backrest base of the bed of FIG. 1.

Referring now to FIG. 6, backrest base 30 is shown in isolation, including attachment point 32 for the pivotal attachment of actuator gearbox 31. Like headrest base 20, backrest base 30 is bordered by circular cross-section tubular steel, and also comprises a strengthening strut 76 also composed of circular cross-section tubular steel adjacent attachment point 32 for the actuator. Flat wooden or stiff elastic slats 77 serve to close the base sufficiently to support the backrest cushion 12. Steel bracket pieces 75 provide attachment pivot point 33.

As will be appreciated, typically a hand-held wired or wireless control is provided to operate the adjustment to a desired position of the headrest 20 and backrest 30 between the operating extremes of the device. The hand-held control may comprise simple independent up-down controls for each motor, or alternatively or in addition may comprise several buttons corresponding to particular positions of each base. Further, the hand-held control can be programmed to operate both actuators synchronously in a programmed relationship to maintain the headrest and backrest in an ergonomically acceptable range.

The invention is particularly useful in providing an adjustable bed for the amelioration of sleep apnoea, but is more generally useful in providing a comfortable inclined sleeping position for any purpose, which tends to align the head, neck and spine, and a regular substantially even flat sleeping surface if desired.

Persons skilled in the art will also appreciate that many variations may be made to the invention without departing from the scope of the invention, which is determined from the broadest scope and claims.

For example, while the embodiment above describes a motorised system, manually operated systems not relying on electricity are within the scope of the invention. Further, embodiments are contemplated where the backrest cushion and lower body cushion are connected or are provided by a single integral flexible cushion. Further still, headrest cushion 10 may not necessarily require an upper part 10*a* which sits proud of the bed surface in a lowermost flat position, in embodiments where the user supplements a conventional pillow, although the overhang provided by upper part 10*a* is optimal. The invention can be applied to double beds while remaining within the scope, with the adjustable head rest and backrest being provided on one side or on both sides, independently adjustable or adjustable together. Further still, embodiments are contemplated where the inclining backrest extends all the way to the foot of the bed and the lower body rest is omitted. Also, embodiments where the shoulder and arm rest is also adjustable in height are within the scope.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. Further, any method steps recited in the claims are not necessarily intended to be performed temporally in the sequence written, or to be performed without pause once started, unless the context requires it.

It is to be understood that, if any prior art publication is referred to herein, such reference does not constitute an admission that the publication forms a part of the common general knowledge in the art, in Australia or any other country.

The invention claimed is:

1. A bed capable of providing postural support to a user, the bed comprising:

a headrest positioned adjacent to a bed head and having an adjustable height;

a backrest positioned between a middle region of the bed and the headrest, the backrest having an adjustable angle of inclination pivoting about the middle region of the bed to incline and elevate the user's back;

a shoulder and arm rest positioned between the headrest and the backrest; and a lower body cushion positioned in a lower region of the bed between a bed foot and the backrest;

wherein the headrest, backrest and the shoulder and arm rest are configurable to form a channel extending between and separating the headrest and the backrest when the headrest and backrest are adjusted in elevated positions, and configurable to form a substantially even sleeping surface of the backrest and shoulder and arm rest without forming the channel when the backrest is adjusted to a flat angle of inclination.

2. The bed of claim 1, wherein the shoulder and arm rest does not have an adjustable height.

3. The bed of claim 1, wherein the headrest comprises a headrest cushion supported by a headrest base, the headrest base being connected to a headrest actuator to provide the adjustable height.

4. The bed of claim 3, wherein the headrest actuator comprises a headrest electric motor and headrest actuator shaft connected to the headrest base thereunder.

5. The bed of claim 1, wherein the backrest comprises a backrest cushion supported by a backrest base, the backrest base being connected to a backrest actuator to provide the adjustable inclination.

6. The bed of claim 5, wherein the backrest actuator comprises a backrest electric motor and backrest actuator shaft connected to the backrest base thereunder.

7. The bed of claim 1, wherein the headrest is adjustable to an elevation of at least 30 mm from a lowermost position of the headrest, and the backrest is adjustable to an angle of inclination of at least 5° from horizontal.

8. The bed of claim 1, wherein the headrest is adjustable to an elevation of at least 60 mm from a lowermost position of the headrest, and the backrest is adjustable to an angle of inclination of at least 10° from horizontal.

9. The bed of claim 1, wherein the headrest is adjustable to an elevation of at least 90 mm from a lowermost position of the headrest, and the backrest is adjustable to an angle of inclination of at least 15° from horizontal.

10. The bed of claim 4, wherein the headrest and the backrest are adjustable continuously.

11. The bed of claim 4, wherein the headrest and the backrest are adjustable to a number of positions.

12. The bed of claim 1, wherein the headrest and the backrest are independently adjustable.

13. An insert capable of being inserted into an outer bed frame in the construction of the bed of claim 1, the insert comprising:

an insert frame framing the insert;

a headrest base positioned adjacent an end of the insert frame adapted to support a headrest cushion and connected through a headrest actuator to the insert frame to provide the adjustable height of the headrest;

a backrest base to support a backrest cushion, the backrest base being positioned between a middle region of the insert and the headrest base and being connected through a backrest actuator to the insert frame to provide the adjustable inclination about a pivoting axis in the middle region of insert; and a shoulder and arm rest base to support a shoulder and arm rest cushion positioned between the headrest base and the backrest base.

14. The insert of claim 13, wherein the insert frame is constructed in two parts, an upper body part receiving the headrest base and backrest base, and a lower body part adapted to support a lower body cushion.

15. The insert of claim 14, wherein the 2 parts are detachable.

16. The insert of claim 13 wherein the headrest actuator is attached to the insert frame at a frame extension disposed beneath the headrest base.

17. The insert of claim 13, wherein the backrest actuator is attached to the insert frame at an extension arm extending beneath a pivot axis of the backrest base.

18. A kit comprising the insert of claim 13, the headrest cushion, the shoulder and arm rest cushion and the backrest cushion.

19. A kit comprising the insert of claim 14, the headrest cushion, the shoulder and arm rest cushion, the backrest cushion and the lower body cushion.

* * * * *